US009159483B2

(12) United States Patent
Murata

(10) Patent No.: US 9,159,483 B2
(45) Date of Patent: Oct. 13, 2015

(54) REACTOR DEVICE

(75) Inventor: Takahito Murata, Toyokawa (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 289 days.

(21) Appl. No.: 13/643,264

(22) PCT Filed: Dec. 27, 2010

(86) PCT No.: PCT/JP2010/073506

§ 371 (c)(1),
(2), (4) Date: Oct. 24, 2012

(87) PCT Pub. No.: WO2012/090258

PCT Pub. Date: Jul. 5, 2012

(65) Prior Publication Data

US 2013/0039815 A1 Feb. 14, 2013

(51) Int. Cl.

*H01F 27/06* (2006.01)
*H01F 27/02* (2006.01)
*H01F 37/00* (2006.01)

(52) U.S. Cl.

CPC ..... *H01F 27/02* (2013.01); *H01F 37/00* (2013.01)

(58) Field of Classification Search

CPC ..... H01F 7/088; H01F 7/12; H01F 7/081; H01F 27/00; H01F 27/06; H02K 2201/18; H02K 41/0356; H01H 50/30; H01H 71/0214
USPC ..... 336/90, 130, 134, 65, 66, 67, 68; 310/179, 194, 51; 335/222, 277
See application file for complete search history.

(56) References Cited

U.S. PATENT DOCUMENTS

| | | | | |
|---|---|---|---|---|
| 6,590,487 | B2 * | 7/2003 | Uchiyama | 336/90 |
| 6,724,908 | B2 * | 4/2004 | Fukuyama | 381/396 |
| 7,855,625 | B2 * | 12/2010 | Varga et al. | 336/90 |
| 7,961,070 | B2 * | 6/2011 | Suzuki et al. | 336/65 |
| 8,035,469 | B2 * | 10/2011 | Okamoto et al. | 336/65 |
| 2004/0226622 | A1 * | 11/2004 | Hayashi | 138/121 |
| 2010/0102912 | A1 | 4/2010 | Suzuki et al. | |
| 2010/0209314 | A1 | 8/2010 | Sato | |

(Continued)

FOREIGN PATENT DOCUMENTS

| | | |
|---|---|---|
| JP | S45436 Y | 1/1970 |
| JP | S50107419 | 8/1975 |

(Continued)

OTHER PUBLICATIONS

International Search Report of PCT/JP2010/073506 mailed Feb. 1, 2011.

*Primary Examiner* — Alexander Talpalatski
*Assistant Examiner* — Joselito Baisa
(74) *Attorney, Agent, or Firm* — Kenyon & Kenyon LLP

(57) ABSTRACT

A reactor device formed by containing a reactor body comprising a plurality of cores joined with each other within a case in a floating state. The reactor body is placed on a case by using leaf spring bodies and a movement of the reactor body in the horizontal direction is allowed, thereby absorbing a difference in expansion resulting from a difference in the thermal expansion coefficient between the reactor body and the case due to a heat stress. Further, a resin mold is inserted into a concave portion of the case so as to allow the movement in the horizontal direction so that the movement of the reactor body along a slope surface can be achieved, thereby absorbing the difference in expansion.

5 Claims, 3 Drawing Sheets

(56) References Cited

U.S. PATENT DOCUMENTS

| | | | | |
|---|---|---|---|---|
| 2012/0044033 | A1 | 2/2012 | Kawaguchi | |
| 2012/0153748 | A1* | 6/2012 | Wauke | 310/25 |

FOREIGN PATENT DOCUMENTS

| | | | |
|---|---|---|---|
| JP | 53-041685 | U | 10/1978 |
| JP | 54-006122 | A | 1/1979 |
| JP | S559561 | U | 1/1980 |
| JP | S568861 | U | 1/1981 |
| JP | S5619022 | U | 2/1981 |
| JP | S6017870 | Y2 | 5/1985 |
| JP | 63-011945 | U | 1/1988 |
| JP | H0270418 | U | 5/1990 |
| JP | H04180611 | A | 6/1992 |
| JP | H04346293 | A | 12/1992 |
| JP | 2004-241475 | A | 8/2004 |
| JP | 2005072198 | A | 3/2005 |
| JP | 2005150517 | A | 6/2005 |
| JP | 2005286020 | A | 10/2005 |
| JP | 2006351653 | A | 12/2006 |
| JP | 2006351654 | A | 12/2006 |
| JP | 2006351674 | A | 12/2006 |
| JP | 2006351675 | A | 12/2006 |
| JP | 2006351719 | A | 12/2006 |
| JP | 2007129146 | A | 5/2007 |
| JP | 2007129149 | A | 5/2007 |
| JP | 2007134374 | A | 5/2007 |
| JP | 2007-180140 | A | 7/2007 |
| JP | 2007180224 | A | 7/2007 |
| JP | 2007180225 | A | 7/2007 |
| JP | 2007227640 | A | 9/2007 |
| JP | 2008021688 | A | 1/2008 |
| JP | 2008028288 | A | 2/2008 |
| JP | 2008028313 | A | 2/2008 |
| JP | 2008098204 | A | 4/2008 |
| JP | 2008108873 | A | 5/2008 |
| JP | 2008112856 | A | 5/2008 |
| JP | 2008117847 | A | 5/2008 |
| JP | 2008117898 | A | 5/2008 |
| JP | 2008-198870 | A | 8/2008 |
| JP | 2008305854 | A | 12/2008 |
| JP | 2008311284 | A | 12/2008 |
| JP | 2009027000 | A | 2/2009 |
| JP | 2009032994 | A | 2/2009 |
| JP | 2009032995 | A | 2/2009 |
| JP | 2009099793 | A | 5/2009 |
| JP | 2009-272508 | A | 11/2009 |
| JP | 2010027692 | A | 2/2010 |
| JP | 2010123927 | A | 6/2010 |
| JP | 2010263074 | A | 11/2010 |
| JP | 2011222694 | A | 11/2011 |
| JP | 2011249427 | A | 12/2011 |
| WO | 2008/093492 | A1 | 8/2008 |

* cited by examiner

REACTOR DEVICE

This is a 371 national phase application of PCT/JP2010/073506 filed 27 Dec. 2010, the contents of which are incorporated herein by reference.

TECHNICAL FIELD

The present invention relates to a reactor device, and more particularly to a structure for holding a reactor body formed of a plurality of cores in a case.

BACKGROUND ART

In the case of configuring a reactor device by winding coils around cores made of a magnetic material, joining of a plurality of cores is performed in order to form a closed magnetic circuit. In this case, if the reactor which is contained in a case by being attached thereto operates and the temperature rises, there is a possibility that stress may act on the joint portion of the cores due to a difference in the thermal expansion coefficients between the case material and the core material.

The following Patent Literature 1 discloses a structure for fixing a reactor body to a case by using a leaf spring. FIGS. 5 and 6 illustrate a structure of a conventional reactor device. FIG. 5 is a cross sectional structural view of a reactor device, and FIG. 6 is a plan view of the reactor device.

A reactor device 10 is configured by including a case 12, a reactor body 30, and leaf spring bodies 20 and 22 for mounting the reactor body 30 to the case 12. The case 12 containing the reactor body 30 is filled with a potting resin 14. The reactor device 10 has a floating structure in which the lower side of the reactor body 30 is attached to the case 12 via the leaf spring bodies 22 and 22.

The reactor body 30 is formed by winding coils 36 and 38 around an element which is formed by molding, with an appropriate resin, an annular core body including combinations of a plurality of cores arranged in an annular shape as a whole. The element formed by molding the annular core body from a resin is composed of one-side body 32 and the other side body 34, as illustrated in FIG. 6.

The one-side body 32 is formed of a plurality of cores and gap plates, which are integrally adhered together using an adhesive, and the other-side body 34 is also formed of a plurality of cores and gap plates, which are integrally adhered together using an adhesive. The end surface of the one-side body 32 and the end surface of the other-side body 34 are integrally adhered with the gap plate being disposed therebetween by using an adhesive.

The coils 36 and 38 are annular coils molded in a hollow shape such that the one-side body 32 and the other-side body 34 formed by molding the annular core body from a resin can be inserted into the coils. One end of each of the coils 36 and 38 is externally led out as a lead line 37, 39 and the other ends are connected with each other. More specifically, the coil 36 which is wound in an annular shape with the lead line 37 being one end is formed, and, after the coil 38 is formed by winding in an annular shape with the other end of the coil 36 being the other end of the coil 38, one end of the coil 38 is led out to serve as the lead line 39. The lead lines 37 and 39 are connected to external bus bars 8 and 9, respectively, at their ends.

The leaf spring bodies 20 and 22 are used to attach the reactor body 30 to the case 12. The leaf spring body 20 is used to attach one end of the reactor body 30 to the case 12, and the leaf spring body 22 is used to attach the other end of the reactor body 30 to the case 12. The leaf spring bodies 20 and 22 are plate members molded by bending the members in an L shape. One side of the L shape has holes for fixing, which are used to fix the leaf spring bodies 20 and 22 to the case 12 by means of bolts 24 and 25 and bolts 26 and 27, respectively, by fastening. The other side of the bent shape is attached to the end of the reactor body 30, by fitting the leaf spring body 20, 22 into a groove provided in the end of the reactor body 30 and fixing them with an appropriate adhesive.

PRIOR ART DOCUMENTS

Patent Literature

Patent Literature 1: JP 2009-272508 A

SUMMARY OF THE INVENTION

Problems to be Solved by the Invention

The primary element of the reactor body 30 is a core which is a magnetic body, and the thermal expansion coefficient of the reactor body 30 depends on the thermal expansion coefficient of the core. Comparing the thermal expansion coefficient of a flat rolled magnetic steel sheet, which is a material of the core, with the thermal expansion coefficient of aluminum, which is a material of the case, the thermal expansion coefficient of aluminum is greater. Accordingly, if the reactor device 10 is operated in a state in which the reactor 30 is attached to the case 12, the reactor body 30 generates heat and the temperature of the case 12 increases with the temperature rise of the reactor body 30. At this time, due to a difference in the thermal expansion coefficient, the case 12 is expanded to a greater degree than the reactor body 30.

According to the conventional technology, while such a difference in the expansion can be absorbed to a certain degree by expansion of the two leaf spring bodies 20 and 22, it is difficult to completely absorb such a difference of expansion. In this case, as both of the one-side body 32 and the other-side body 34 formed by integrating a plurality of cores and gap plates by using an adhesive will be subject to a tensile stress due to a difference in the expansion, it can be expected that the stress will be concentrated on the joint portion of the cores and the gap plates to separate the cores and the gap plates from each other, thereby reducing the NV (noise vibration) performance. Further, in the structure in which the leaf springs are fixed to the case, which requires fastening members, there arises a problem that the size of the reactor device is enlarged and also the number of components is increased, leading to increase in costs.

The advantage of the present invention is to provide a reactor device in which reliability with respect to a heat stress (or temperature stress) can be increased.

Solution to Problems

In accordance with an aspect of the invention, there is provided a reactor device including a reactor body formed by joining a plurality of cores, a case that contains the reactor body, and an engaging member that engages both end portions of the reactor body with the case so as to allow a movement of the reactor body with respect to the case in the horizontal direction and allows the reactor body to float within the case.

According to one embodiment of the present invention, the engaging member includes a leaf spring having one end integrated with the reactor body and the other end placed on an upper surface of the case.

According to another embodiment of the present invention, the other end of the leaf spring is fitted into a groove formed on the upper surface of the case and the movement in the horizontal direction is allowed by the groove.

Further, according to another embodiment of the present invention, the reactor device includes a retainer which is disposed on the upper surface side of the leaf spring to restrict a movement of the reactor body in the upward direction.

Also, according to another embodiment of the present invention, the engaging member includes a mold resin having one end integrated with the reactor body and the other end being inserted in a concave portion of the case with a predetermined gap being provided in the horizontal direction.

Furthermore, according to another embodiment of the present invention, the case includes, on a surface which is opposite to the mold resin, a case side slope surface such that an inner side of the case is relatively lower, the mold resin includes, in a surface which is opposite to the case, a resin side slope surface which is in contact with the case side slope surface, and the reactor body is held by the case side slope surface at the resin side slope surface and is movable with respect to the case along the case side slope surface.

Additionally, according to another embodiment of the present invention, the reactor device includes a retainer which is disposed on the upper surface side of the mold resin to restrict a movement of the reactor body in the upward direction.

Advantageous Effects of Invention

According to the present invention, it is possible to increase the reliability of a reactor device with respect to a heat stress. Further, according to the present invention, the size of the reactor device can be reduced compared to conventional devices. Moreover, according to the present invention, NV performance can be enhanced.

MODE FOR CARRYING OUT THE INVENTION

Figure 1:
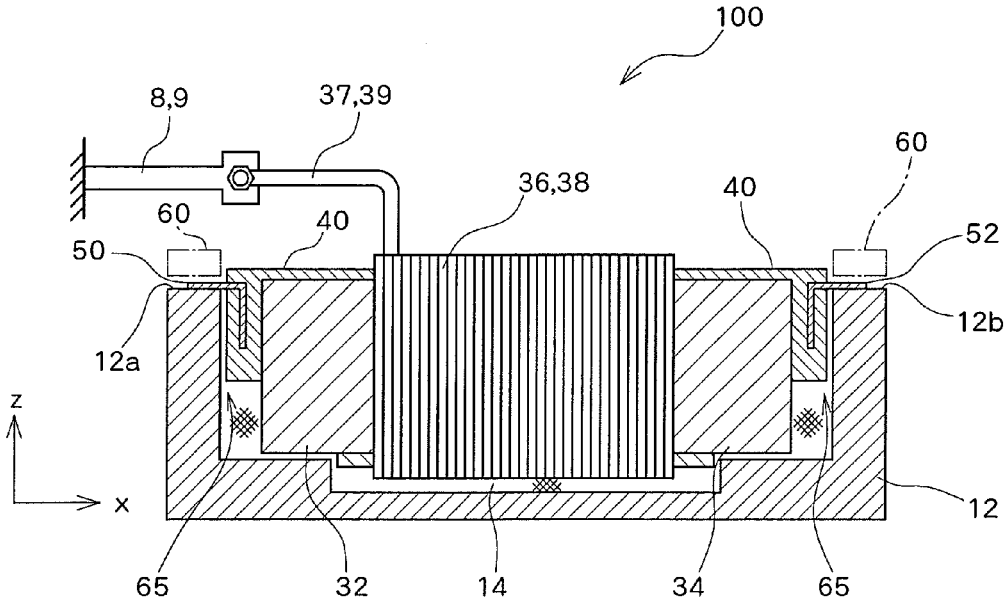
FIG. 1 Cross sectional view illustrating a structure of a reactor device according to a first embodiment.

Preferred embodiments of the invention will be described with reference to the drawings.

1. Fundamental Principle

The fundamental principle of the present embodiments will be described first. According the fundamental principle of the present embodiments, in a structure in which a reactor body formed by joining a plurality of cores is contained within a case with the reactor body floating from the case, a leaf spring body which is integrated with the reactor body by using a resin is engaged with the case such that the leaf spring body is movable in the horizontal direction, rather than fixing the leaf spring body to the case by using a bolt as in the conventional structure.

The reactor device is mounted in hybrid vehicles, electric vehicles, or the like, and in this case, the movement of the vehicle in the horizontal direction does not cause any significant problems compared to the movement of the vehicle in the upward and downward directions. With the structure in which a leaf spring body integrated with a reactor body by using a resin is attached to a case by placing the leaf spring body on the case rather than fixing the leaf spring body with a bolt, if there is a difference in expansion resulting from a difference in thermal expansion coefficient between the reactor body and the case when the reactor body is operated, because the leaf spring body is not fixed and is movable in the horizontal direction, the difference in the expansion can be cancelled by the movement of the leaf spring body on the case, i.e. by the frictional movement of the leaf spring body on the case. Consequently, concentration of the stress in the core joint portion of the reactor body can be restricted.

As the movement of the reactor body in the upward and downward direction can be restricted by a potting resin filling the case that contains the reactor body, the reactor body is prevented from coming out of the case with the movement of the vehicle in the upward and downward direction during traveling. In addition to the restriction by means of the potting resin, the movement of the leaf spring body, that is the reactor body, in the upward direction may be restricted by providing a retainer above the leaf spring body.

In the conventional reactor device, under the technical concept that the reactor body is integrated with the case, the reactor body is fixed to the case. According to the present embodiments, however, such a technical concept of integrating the reactor body with the case is not adopted, and a technical concept that the reactor body and the case are separate members and the reactor body is engaged with the case such that they are relatively movable in the horizontal direction, rather than fixing the reactor body to the case, is adopted. According to the present embodiments, as the leaf spring body is not fixed to the case, a fastening section is not necessary, which can reduce the size of the reactor device accordingly and also can reduce the number of components.

While the reactor body is placed on the case or suspended by the leaf spring bodies, a mold resin itself which is integrally molded with the reactor body, in place of the leaf spring body, may be placed on the case. In this case, with the structure in which the shape of the case side and the shape of the mold resin side are engageable with each other so as to establish an engagement relationship in which reactor body is movable in the horizontal direction, effects of the heat stress can be suppressed.

Figure 5:
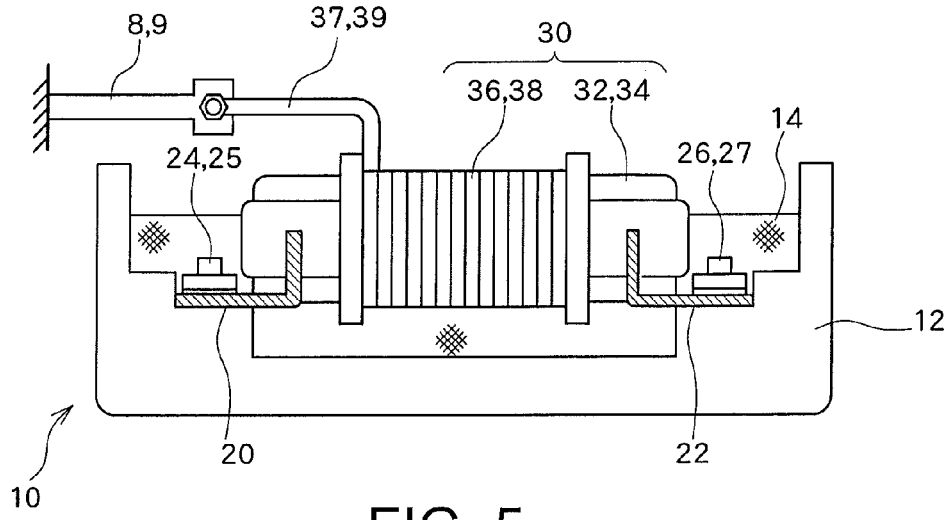
FIG. 5 Cross sectional view illustrating a structure of a conventional reactor device.
Figure 6:
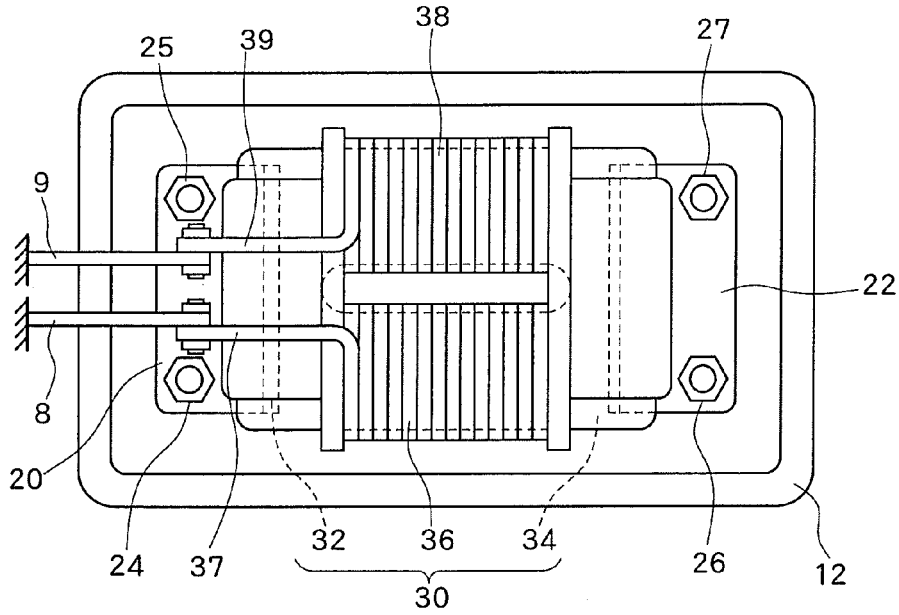
FIG. 6 Plan view illustrating the conventional reactor device.

The structure of the present embodiments will be specifically described. In the following description, elements which are the same as or correspond to the elements of the conventional reactor device illustrated in FIGS. 5 and 6 are denoted by the same reference numerals. Further, the following embodiments are merely examples, and the present invention is not limited to these examples.

2. First Embodiment

Figure 2:
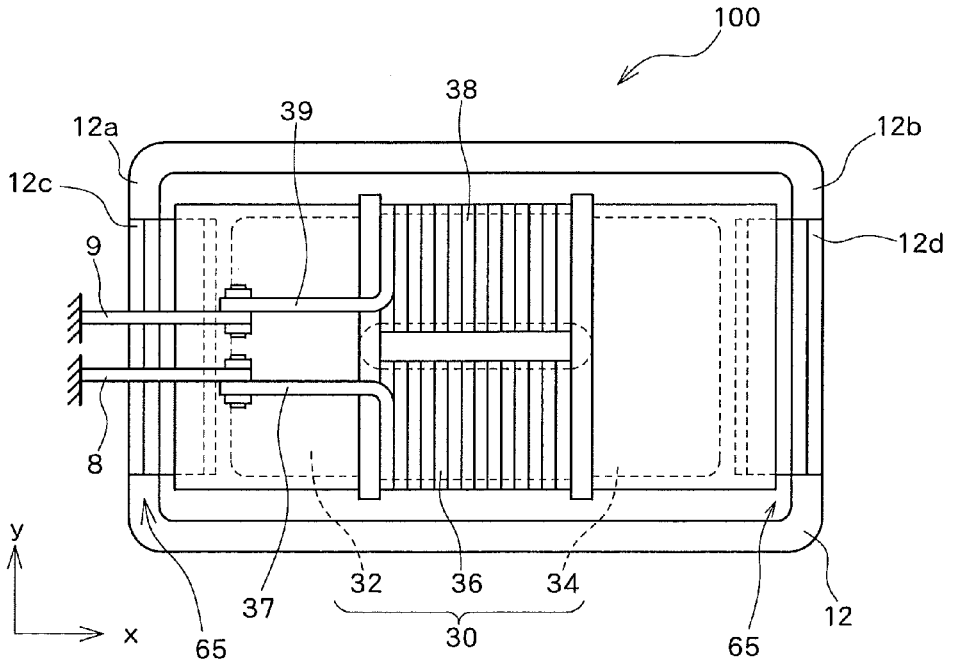
FIG. 2 Plan view illustrating the reactor device according to the first embodiment.

FIG. 1 illustrates a cross sectional view of a structure of a reactor device 100 according to the present embodiment. Further, FIG. 2 illustrates a plan view of the reactor device according to the present embodiment.

The reactor device 100 is configured by including a case 12, a reactor body 30, and leaf spring bodies 50 and 52 for placing or suspending the reactor body 30 in the case 12. The case 12 that contains the reactor body 30 is filled with a potting resin 14. For the potting resin 14, a resin having a heat resistant property and appropriate elasticity can be used, and a silicon resin can be used, for example. During the operation of the reactor device 100, heat generated by the reactor body is conveyed to the case 12 by the potting resin 14 and is discharged from the case 12.

The reactor device 100 has a floating structure in which both end portions of the reactor body 30 are mounted on the case 12 via spring bodies 50 and 52. The reactor body 30 is formed by winding coils 36 and 38 around an element which is formed by molding, with an appropriate resin, an annular core body including combinations of a plurality of cores arranged in an annular shape as a whole. More specifically, C-shape or U-shape cores and I-shape or rod-shape cores are combined and joined together by an adhesive, with a gap plate being interposed between adjacent cores, and are then integrally formed in an annular shape with a resin. The annular core body is formed of a one-side body 32 and an other-side body 34. The one-side body 32 is formed by integrating a plurality of cores and gap plates with an adhesive as described above, and the other-side body 34 is similarly formed by integrating a plurality of cores and gap plates with an adhesive. The end surface of the one-side body 32 and the end surface of the other-side body 34 are integrated by an adhesive with a gap plate being interposed therebetween.

The coils 36 and 38 are annular coils molded in a hollow shape such that the one-side body 32 and the other-side body 34 formed by molding the annular core body with a resin can be inserted into the coils. One end of each of the coils 36 and 38 is externally led out as a lead line 37, 39 and the other ends are connected with each other. More specifically, the coil 36 which is wound in an annular shape with the lead line 37 being one end is formed, and, after the coil 38 is formed by winding in an annular shape with the other end of the coil 36 being the other end of the coil 38, one end of the coil 38 is led out to serve as the lead line 39. The lead lines 37 and 39 are connected to external bus bars 8 and 9, respectively, at their ends.

The leaf spring bodies 50 and 52 function as members that engage the reactor body 30 with the case 12. The leaf spring body 50 is used to mount one end of the reactor body 30 on the case 12 and the leaf spring body 52 is used to mount the other end of the reactor body 30 on the case 12. The leaf spring bodies 50 and 52 are plate members molded by bending the members in an L shape. One side of the leaf spring body 50 is integrated with the reactor body 30 with a mold resin 40, and the other side of the leaf spring body 50 is placed on the upper surface 12*a* of the case 12. The upper surface 12*a* of the case 12 includes a groove 12*c* formed as a recess portion as illustrated in FIG. 2. The groove 12*c* is formed to extend in the x-direction and has a width in the y-direction which is substantially the same as the width of the leaf spring body 50. The leaf spring body 50 is fitted into the groove 12*c* formed on the upper surface 12*a* of the case 12 and thus placed on the case 12. While the leaf spring body 50 is movable in the x-direction within the groove 12*c*, the movement of the leaf spring body 50 in the y-direction is restricted by the groove 12*c*. Further, one side of the leaf spring body 52 is integrated with the reactor body 30 with the mold resin 40, and the other side thereof is placed on the upper surface 12*b* of the case 12. The upper surface 12*b* of the case 12 includes, as with the upper surface 12*a*, a groove 12*d* extending in the x-direction and having a width in the y-direction which is substantially the same as the width of the leaf spring body 52. The leaf spring body 52 is fitted into the groove 12*d* and placed on the case 12. While the leaf spring body 52 is movable in the x-direction within the groove 12, the movement of the leaf spring body 52 in the y-direction is restricted by the groove 12*d*. As the leaf spring body 50 engages with the groove 12*c* and the leaf spring body 52 engages with the groove 12*d*, it can be considered that the leaf spring body 50 and the groove 12*c* function as a pair of engaging members and also the leaf spring body 52 and the groove 12*d* function as a pair of engaging members.

In the drawings, assuming that the x and y directions are horizontal directions and the z direction is a normal direction, the reactor body 30 is placed on the case 12 in the horizontal direction with respect to the case 12. The reactor body 30 is placed on the upper surfaces 12*a* and 12*b* of the case 12 by the leaf spring bodies 50 and 52. As a gap 65 is formed between the case 12 and the mold resin 40, the leaf spring bodies 50 and 52 are movable in the horizontal direction (x direction) on the upper surfaces 12*a* and 12*b* of the case 12. On the other hand, as the potting resin 14 is filled between the reactor body 30 and the case 12, the movement of the reactor body 30 in the upward and downward direction (z direction) is restricted by the potting resin 14.

Further, as illustrated in FIG. 1, a retainer 60 (indicated by a line-dot line in the drawing) can be additionally provided above each of the leaf spring bodies 50 and 52 with a predetermined interval between the retainer 50 the leaf spring body 50, 52, to thereby further restrict the movement of the reactor body 30 in the upward direction.

In the present embodiment, while the reactor body 30 is contained in the case 12 by the leaf spring bodies 50 and 52, because the leaf spring bodies 50 and 52 are not fixed to the case by using bolts and are placed on the upper surfaces 12*a* and 12*b* of the case 12, the leaf spring bodies 50 and 52 are movable in the horizontal direction. Accordingly, even when the reactor device 10 is operated and the reactor body 30 generates heat to increase the temperature of the case 12 with the increase in the temperature of the reactor body 30, in which case the case 12 expands to a greater degree than the reactor body 30 due to the difference in the thermal expansion coefficient, such a difference in the expansion can be absorbed not only by the elastic force of the leaf spring bodies 50 and 52 but also by the movement of the leaf spring bodies 50 and 52 in the horizontal direction (x direction).

More specifically, the amount of the difference in the expansion which cannot be absorbed by the elastic force of the leaf spring bodies 50 and 52 can be absorbed by the movement of the leaf spring bodies 50 and 52 in the horizontal direction. Consequently, concentration of stress in the joint portion of a plurality of cores can be suppressed effectively, so that a reduction in the NV performance caused by separation of the joint portion of the plurality of cores can be suppressed.

Further, according to the present embodiment, because the leaf spring bodies 50 and 52 are not fixed to the case 12 by bolts, contrary to the conventional configuration, it is possible to remove the fastening portion to thereby allow a reduction in the size of the reactor device 100.

3. Second Embodiment

While in the first embodiment described above, a configuration in which the reactor 30 is contained in the case 12 by using the leaf spring bodies 50 and 52 has been described, a structure in which the reactor body 30 is contained within the case 12 without using the leaf spring bodies 50 and 52 will be described in the present embodiment.

Figure 3:
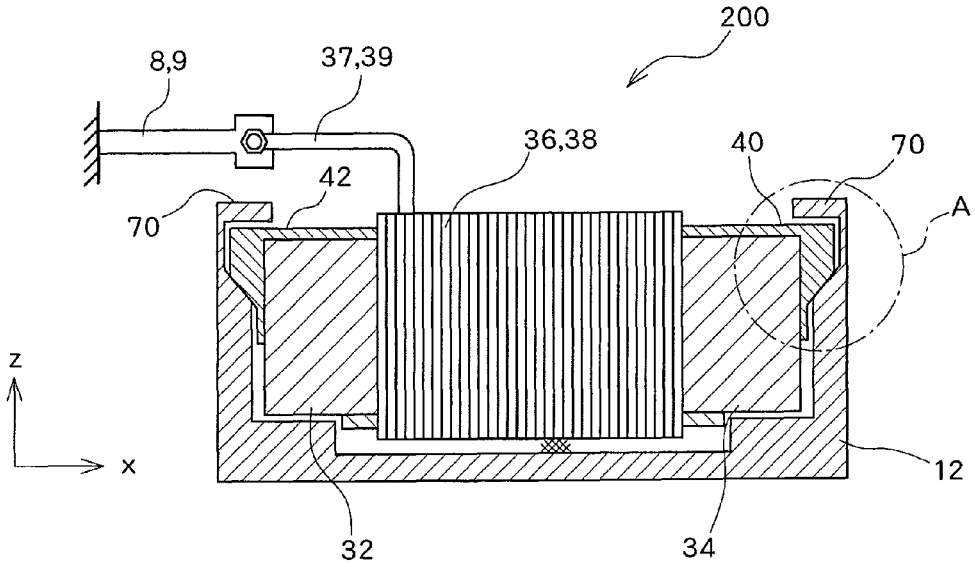
FIG. 3 Cross sectional view illustrating a structure of a reactor device according to a second embodiment.
Figure 4:
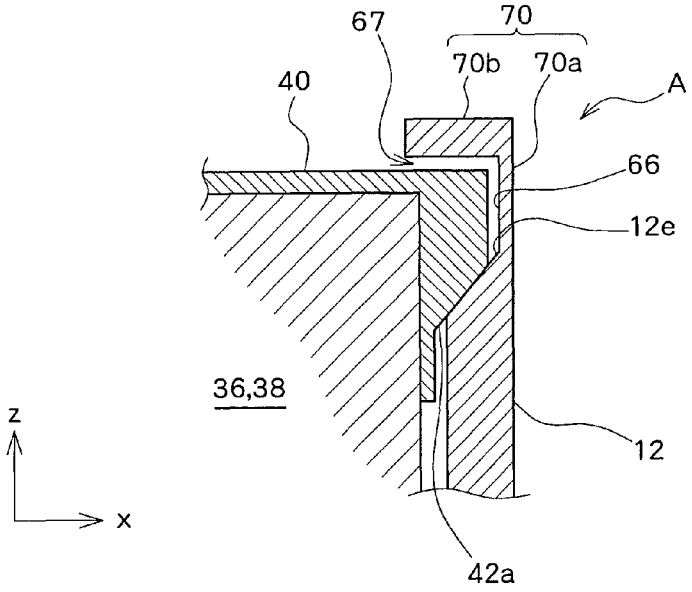
FIG. 4 Partial enlarged view of FIG. 3.

FIG. 3 illustrates a cross sectional view of a structure of a reactor device 200. Further, FIG. 4 illustrates a partial enlarged view of the portion A in FIG. 3.

The reactor device 200 is configured by including a case 12, a reactor body 30, and a mold resin 42 for placing or suspending the reactor body 30 in the case 12. The case 12 which contains the reactor body 30 is filled with a potting resin 14. The reactor device 200 has a floating structure in which sides of the reactor body 30 are mounted on the case via the mold resin 42.

The reactor body 30, similar to the first embodiment, is formed by winding coils 36 and 38 around an element which is formed by molding, with an appropriate resin, an annular core body including combinations of a plurality of cores arranged in an annular shape as a whole. The element which is formed by molding an annular core body with a resin is formed of a one-side body 32 and an other-side body 34.

The coils 36 and 38 are annular coils molded in a hollow shape such that the one-side body 32 and the other-side body 34 formed by molding the annular core body with a resin can be inserted into the coils. As in the first embodiment, one end of each of the coils 36 and 38 is externally led out as a lead line 37, 39 and the other ends are connected with each other. More specifically, the coil 36 which is wound in an annular shape with the lead line 37 being one end is formed, and, after the coil 38 is formed by winding in an annular shape with the other end of the coil 36 being the other end of the coil 38, one end of the coil 38 is led out to serve as the lead line 39. The lead lines 37 and 39 are connected to external bus bars 8 and 9, respectively, at their ends.

On the other hand, the mold resin 42 in the present embodiment functions as a member which allows the reactor body 30 to engage with the case 12 in place of the leaf spring bodies 50 and 52. The mold resin 42 is integrated with the cores of the reactor body 30 or with the one-side body 32 at one end, and engages with the upper surface of the case 12 at the other end. This engagement state will be described below.

As illustrated in the partial enlarged view of FIG. 4, a slope surface (case-side slope surface) 12*e* facing toward the inner side of the case 12 is formed on the upper surface of the case 12. Specifically, the upper surface of the case includes the slope surface 12*e* such that the height of the upper surface in the z direction is relatively lower on the inner side of the case 12 and is relatively higher on the outer side of the case 12. While the angle of inclination of the slope surface 12*e* is arbitrary, the inclination angle is set so as to form 45 degrees with respect to the horizontal direction, for example.

Also, a surface of the mold resin 42 which is opposite to the slope surface 12*e* of the case 12 is formed as a slope surface (resin-side slope surface) 42*a*. The angle of inclination of the slope surface 42*a* is the same as the angle of inclination of the slope surface 12*e*, and the slope surface 12*e* and the slope surface 42*a* are in contact with each other. The mold resin 42 and the reactor body 30 are held at the slope surface 42*a* by the slope surface 12*e* on the case side 12.

Further, a retainer 70 is formed above the slope surface 12*e* of the case 12. The retainer 70 is molded by bending to have an L-shape cross section and is composed of two portions 70*a* and 70*b* that are orthogonal to each other. The portion 70*a* is joined to a case outer end portion of the slope surface 12*e* of the case 12. The portion 70*b* extends toward the inner direction of the case 12. Accordingly, the slope surface 12*e* of the case 12 and the portions 70*a* and 70*b* of the retainer 70 together form a concave portion of the case 12 facing the inner side of the case 12. On the other hand, the mold resin 42 is formed projecting from the reactor body 30 and is inserted into the concave portion of the case 12. It can be understood that the mold resin 42 and the concave portion of the case 12 or the slope surface 12*e* of the case and the retainer 70 function as a pair of engaging members.

In a state in which the slope surface 12*e* of the case 12 and the slope surface 42*a* of the mold resin 42 are in contact with each other, a gap 66 is formed between the portion 70*a* of the retainer 70 and the opposing surface of the mold resin 42, and also a gap 67 is formed between the portion 70*b* of the retainer 70 and the opposing surface of the mold resin 42.

As described above, the reactor body 30 is contained in the case 12 via the mold resin 42, and the slope surface 42*a* of the mold resin 42 and the slope surface 12*e* of the case 12 are in contact with each other and the mold resin (42?) is movable along the inclining direction of the slope surface 12*e*. Accordingly, even when the reactor device 200 is operated and the reactor body 30 generates heat to increase the temperature of the case 12 with the increase in the temperature of the reactor body 30, in which case the case 12 expands to a greater degree than the reactor body 30 due to the difference in the thermal expansion coefficient, such a difference in the expansion can be absorbed by the movement of the mold resin 42 in the direction along the angle of inclination. Consequently, concentration of the stress in the joint portion of the plurality of cores can be suppressed effectively. Also, in the present embodiment, because the upward movement of the reactor body 30 can be restricted by the portion 70*b* of the retainer 70, it is also possible to effectively prevent the reactor body 30 from coming out of the case 12. Further, in the present embodiment, as in the first embodiment, as the fastening member for fixing the reactor body 30 to the case 12 is not necessary, the size of the reactor device 200 can be reduced accordingly. In addition, according to the present embodiment, because the contacting portion of the reactor body 30 and the case 12 corresponds to the mold resin 42 and also the contacting portion has an inclination of 45 degrees with respect to the horizontal direction, the NV performance can be increased compared to the case of fixing with bolts.

4. Modification Examples

While the embodiments of the present invention have been described, other modification examples are also applicable.

For example, while in the first embodiment one end of each of the leaf spring bodies 50 and 52 is integrated with the reactor body 30 by the mold resin 40, a structure in which one end of each of the leaf spring bodies 50 and 52 is fitted into a groove provided in the end portion of the reactor body and joined to the reactor body with an appropriate adhesive may also be adopted. In other words, in the first embodiment, the mold resin 40 is not essential.

Further, while in the first embodiment the movement of the leaf spring bodies 50 and 52 in the horizontal direction (z direction) is not restricted and is allowed, a stopper member may be disposed in the horizontal direction so as to allow the movement in the horizontal direction within a predetermined range but restrict the movement exceeding the predetermined range. In other words, the first embodiment is not necessarily limited to the structure in which unlimited movement of the leaf spring members 50 and 52 or the reactor body 30 in the horizontal direction (x direction) is allowed.

In addition, while in the second embodiment the upward movement of the reactor body 30 is restricted by the portion 70*b* of the retainer 70, the upward movement of the reactor body 30 is restricted to a certain degree by the potting resin 14 as described in the first embodiment, and the portion 70*b* disposed above the mold resin 42 is not essential.

REFERENCE SIGNS LIST

8, 9 bus bar, 12 case, 14 potting resin, 30 reactor body, 32 one-side body, 34 other-side body, 36, 38 coil, 40, 42 mold resin, 50 52 leaf spring, 60, 70 retainer.

The invention claimed is:

1. A reactor device to be mounted in a vehicle comprising:

a reactor body formed by joining a plurality of cores;

a case that contains the reactor body; and an engaging member that engages both ends of the reactor body with the case so as to allow a movement of the reactor body in a horizontal direction with respect to the case in a state in which the reactor is mounted in a vehicle, and allows the reactor body to float within the case, rather than fixing the reactor body to the case by fastening, wherein the engaging member comprises a leaf spring having one end integrated with the reactor body and the other end placed on an upper surface of the case, the other end being not fixed to the case by fastening, the leaf spring being freely movable in at least one direction with respect to the upper surface of the case.

2. The reactor device according to claim 1, wherein the other end of the leaf spring is fitted into a groove formed on the upper surface of the case and the movement in the horizontal direction is allowed by the groove.

3. The reactor device according to claim 2, comprising:

a retainer which is disposed on the upper surface side of the leaf spring to restrict a movement of the reactor body in the upward direction.

4. A reactor device to be mounted in a vehicle, comprising:

a reactor body formed by joining a plurality of cores;

a case that contains the reactor body; and an engaging member that engages both ends of the reactor body with the case so as to allow a movement of the reactor body in a horizontal direction with respect to the case in a state in which the reactor is mounted in a vehicle, and allows the reactor body to float within the reactor body rather than fixing the reactor body to the case by fastening, wherein the engaging member comprises a mold resin having one end integrated with the reactor body and the other end being inserted in a concave portion of the case with a predetermined gap being provided in the horizontal direction, the other end being not fixed to the case by fastening, the case includes, on a surface which is opposite to the mold resin, a case side slope surface such that an inner side of the case is relatively lower, the mold resin includes, on a surface which is opposite to the case, a resin side slope surface which is in contact with the case side slope surface, and the reactor body is held by the case side slope surface at the resin side slope surface and is movable with respect to the case along the case side slope surface.

5. The reactor device according to claim 4, comprising:

a retainer which is disposed on the upper surface side of the mold resin to restrict a movement of the reactor body in the upward direction.

* * * * *